US006001770A

United States Patent [19]

Simpson et al.

[11] Patent Number: 6,001,770

[45] Date of Patent: Dec. 14, 1999

[54] SLIPPING LAYER FOR DYE-DONOR ELEMENT USED IN THERMAL DYE TRANSFER

[76] Inventors: William H. Simpson; Jacob J. Hastreiter, Jr.; Ronald M. Wexler; Daniel F. Hurley; George B. Bodem, all of Eastman Kodak Company, 343 State St., Rochester, N.Y. 14650

[21] Appl. No.: 08/976,772

[22] Filed: Nov. 24, 1997

[51] Int. Cl.[6] ..... B41M 5/035; B41M 5/38

[52] U.S. Cl. ..... 503/227; 438/195; 438/327; 438/913; 438/914

[58] Field of Search ..... 8/471; 428/195, 428/323, 327, 913, 914; 503/227

[56] References Cited

U.S. PATENT DOCUMENTS 4,892,860 1/1990 Vanier ..... 503/227

*Primary Examiner*—Bruce H. Hess

[57] ABSTRACT

A dye-donor element for thermal dye transfer comprising a support having on one side thereof a dye layer and on the other side a slipping layer comprising a binder containing polyalkylsilsesquioxane particles wherein less than about 8% of the particles have a diameter of >0.8 $\mu$m.

15 Claims, No Drawings

SLIPPING LAYER FOR DYE-DONOR ELEMENT USED IN THERMAL DYE TRANSFER

FIELD OF THE INVENTION

This invention relates to dye-donor elements used in thermal dye transfer, and more particularly to the use of a certain slipping layer on the back side thereof which contains lubricating particles.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head, preventing donor transport. A slipping layer is typically provided to facilitate passage of the dye-donor under the thermal printing head.

Dye diffusion thermal printing requires intimate contact between the thermal head and the slipping layer of the dye-donor element to transfer as much energy as possible from the thermal head to the donor. More efficient heat transfer results in higher transferred dye densities and faster line times.

It is well known in the thermal printing art that particles can be used in the slipping layer to keep the thermal print head free of dirt and debris. The particles can be large organic particles or smaller inorganic particles. The abrasive action of the particles cleans the thermal print head.

DESCRIPTION OF RELATED ART

U.S. Pat. No. 4,892,860 discloses the incorporation of lubricating particles of polymethylsilsesquioxane, such as Tospearl 120®, to reduce the transfer of dye from the dye layer to the backside slipping layer when the dye-donor element is wound onto a spool. There is a problem with using these particles, however, at dry laydowns equivalent to those needed to clean the thermal head in that the transferred dye density is reduced.

It is an object of this invention to allow the use of polyalkylsilsesquioxane particles in a slipping layer of a dye-donor element at a level necessary for maintaining a clean thermal head without sacrificing dye density.

SUMMARY OF THE INVENTION

This and other objects are achieved in accordance with this invention which relates to a dye-donor element for thermal dye transfer comprising a support having on one side thereof a dye layer and on the other side a slipping layer comprising a binder containing polyalkylsilsesquioxane particles wherein less than about 8% of the particles have a diameter of >0.8 $\mu$m.

DESCRIPTION OF THE PREFERRED EMBODIMENTS

It has been found unexpectedly that use of polyalkylsilsesquioxane particles having the above particle size distribution in a slipping layer produces no loss in print density when these particles are incorporated into a dye-donor slipping layer. The reduction in particle size distribution can be obtained by milling the polyalkylsilsesquioxane particles in the presence of a grinding medium. A reduction in the number of large particles can also be accomplished by other techniques such as settling or centrifugation, which would accomplish the same purpose as milling. Also, the initial preparation of the polyalkylsilsesquioxane particles could be modified to produce a narrower particle size distribution.

It is believed that when large diameter, hard, incompressible particles such as polyalkylsilsesquioxane are contained in a slipping layer, the particles cause the thermal head to be separated from the slipping layer, resulting in less energy being transferred to the dye-donor element. This affects the dye transfer and results in a lower print density.

The particles used in the invention can be dispersed using a dispersing medium. The dispersing medium is preferably a non-aqueous solvent of sufficient volatility so that it does not remain in the coated slipping layer. Solvents that could be used include organic solvents such as esters, ketones, chlorinated hydrocarbons and the like. The preferred solvent for the dispersing medium is a lower alkyl ketone containing from 3 to 7 carbon atoms. Exemplary useful ketones include acetone, methyl ethyl ketone, diethyl ketone and the like. The dispersing medium can be present in the dispersion during milling in an amount of about 25 to 99.9%, preferably from about 50 to 80%, by weight The polyalkylsilsesquioxane particles employed in the invention preferably are spherical or nearly spherical in shape. In a preferred embodiment of the invention, the polyalkylsilsesquioxane particles are polymethylsilsesquioxane particles. In another preferred embodiment, the particles have a median diameter of less than about 0.6 $\mu$m.

Prior to milling, the particles may have a median diameter of about 0.7 $\mu$m or more. After milling, the particles may have a median diameter of 0.6 $\mu$m or less. The polyalkylsilsesquioxane particles are present in the dispersion in an amount of about 0.1% to about 75% by weight. In a preferred embodiment, the particles are present in an amount of from 10% to 50% by weight.

The dispersion described above can be prepared by procedures known to those in the dispersion art. The dispersion can be prepared by the use of a dispersing machine, for example, a ball mill, a roll mill, a high-speed impeller mill, an attritor, or a sand mill. The media used in the mill can be glass, zirconia, zirconium silicate, stainless steel, tungsten carbide and the like having a diameter of from about 0.5 mm to about 4 mm. In order to keep contamination to a minimum, gasket materials are chosen that exhibit no solubilization or swelling when in contact with the dispersing medium. When using the preferred solvents, lower alkyl ketones, preferred gasket materials are ethylene, propylene, butylbutadiene, ethylene propylene diene monomer, and perfluoroelastomers. The milling operation can be performed in glass, ceramic, or steel equipment. Preferably, the milling operation is performed in glass or ceramic equipment or equipment lined with such materials. To obtain the desired particle size distribution, the percent by weight of particle in the dispersing medium, the volume ratio of particle to medium in the mill, and the milling time are adjusted appropriately.

In a preferred embodiment of the invention, less than 4% of the particles have a diameter of >0.8 $\mu$m.

The amount of polyalkylsilsesquioxane particles used in the slipping layer of the invention can be present in the range of 0.05 to 70 weight %, preferably 5 to 60 weight %, of the binder employed.

Any binder can be used in the slipping layer employed in the invention as long as it provides the desired function. Suitable binders for the slipping layer include polymers such as poly(vinyl alcohol-co-butyral), poly(vinyl alcohol-co-acetal), polystyrene, poly(vinyl acetate), cellulose acetate butyrate, cellulose acetate propionate, cellulose acetate, or ethyl cellulose, etc.

Any dye can be used in the dye layer of the dye-donor element of the invention provided it is transferable to the dye-receiving layer by the action of heat. Especially good results have been obtained with sublimable dyes such as Magenta Dye 1

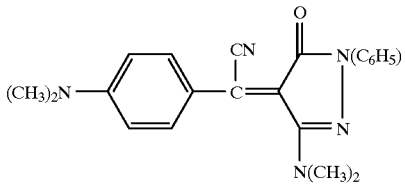

Magenta Dye 2

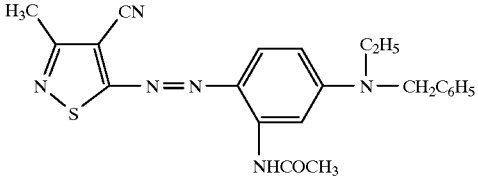

Magenta Dye 3

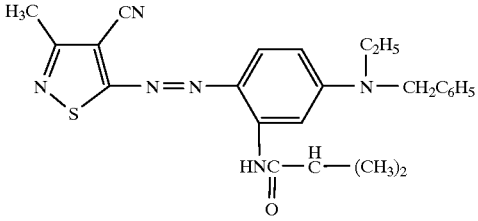

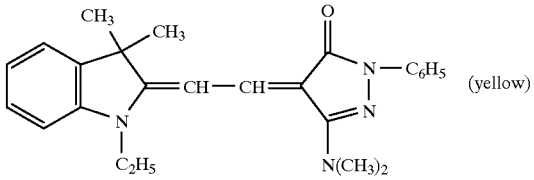

(yellow)

-continued

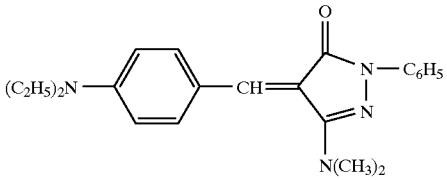

(yellow)

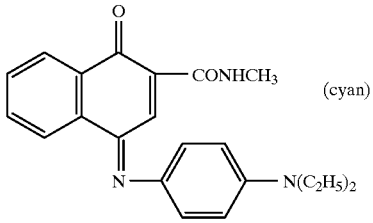

(cyan)

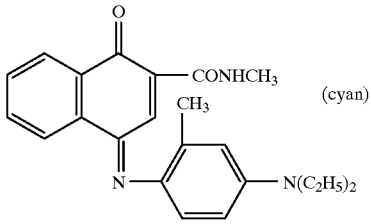

(cyan)

or any of the dyes disclosed in U.S. Pat. No. 4,541,830, the disclosure of which is hereby incorporated by reference. The above dyes may be employed singly or in combination to obtain a monochrome dye transfer image. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 $\mu$m. It may also be coated with a subbing layer, if desired, such as those materials described in U.S. Pat. Nos. 4,695,288 or 4,737,486.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly (vinyl chloride), poly(styrene-co-acrylonitrile), polycaprolactone or mixtures thereof. The dye image-receiving layer may be present in any amount which is effective for the intended purpose. In general, good results have been obtained at a laydown or dry coverage of from about 1 to about 5 g/m$^2$.

As noted above, the dye-donor elements of the invention are used to form a dye transfer image. Such a process comprises imagewise heating a dye-donor element as described above and transferring a dye image to a dye receiving element to form the dye transfer image.

The dye-donor element of the invention may be used in sheet form or in a continuous roll or ribbon. If a continuous roll or ribbon is employed, it may have only one dye or may have alternating areas of different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan, and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089, or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled off to reveal the dye transfer image.

When a three-color image is to be obtained, the above assemblage is formed on three occasions during the time when heat is applied by the thermal printing head. After the first dye is transferred, the elements are peeled apart A second dye-donor element (or another area of the donor element with a different dye area) is then brought into register with the dye-receiving element and the process is repeated. The third color is obtained in the same manner.

The following example is provided to illustrate the invention.

EXAMPLE

Dye-Donor Element

On both sides of a 6.4 μm poly(ethylene terephthalate) film (DuPont Co.) was coated a subbing layer of Tyzor TBT®, a titanium tetrabutoxide, (DuPont Co.) (0.12 g/m$^2$) coated from 1-butanol. This served as support for dye layer and slipping layer, respectively.

The dye layer comprised Magenta Dye 1 at 0.1 80 g/m$^2$, Magenta Dye 2 at 0.086 g/m$^2$, PIDA Amide (2,4,6-trimethylanilide of phenylindan-diacid glass) at 0.068 g/m$^2$, 0.097 g/m$^2$ CAP 482-0.5 (cellulose acetate propionate, 0.5 sec viscosity) and 0.268 g/m$^2$ of CAP 482-20 (cellulose acetate propionate, 20 sec viscosity) (all from Eastman Chemical Co), Fluorad FC430® fluorosurfactant (3M Co.) at 0.0011 g/m$^2$, Paraplex G-25® (polyester sebacate) (C. P. Hall Co.) at 0.073 g/m$^2$, and 2 μm divinylbenzene beads at 0.0066 g/m$^2$. The dye-donor element was coated from a 70/25/5 wt-% toluene/methanol/cyclopentanone solvent mixture.

Slipping layers were coated on the other side (opposite to the dye layer) of the above support as follows:

Control No. 1—The subbing layer was overcoated with a layer containing 0.38 g/m$^2$ KS-1, poly(vinyl acetal) (Sekisui Co.), 0.02 g/m$^2$ candelilla wax (Strahl & Pitsch), 0.0003 g/m$^2$ p-toluenesulfonic acid (Eastman Kodak Co.) and 0.009 g/m$^2$ PS-513 (United Chemical Technologies Co.), coated from 3-pentanone.

Control No. 2—The subbing layer was overcoated with a layer containing 0.38 g/m$^2$ KS-1, poly(vinyl acetal), 0.02 g/m$^2$ candelilla wax, 0.0003 g/m$^2$ p-toluenesulfonic acid, 0.009 g/m$^2$ PS-513 and 0.054 g/m$^2$ Tospearl 120® (a silicone resin powder of 2 μm spherical size from GE—Toshiba Silicone, Ltd.), coated from 3-pentanone.

Comparison No. 1—This was the same as Control No. 2, except the Tospearl 120® was replaced with Tospearl 105®.

Comparison No. 2—This was the same as Control No. 3, except the amount of Tospearl 105® was increased to 0.215 g/m$^2$.

Example No. 1—This was the same as Control No. 2, except the Tospearl 105® was replaced with ground Tospearl 105® having a median diameter of 0.31 μm and only 0.1% of the particles having a particle size greater than 0.7 μm (see Table I).

Example No. 2—This was the same as Example No. 1, except the Tospearl 105® was replaced with 0.108 g/m$^2$ ground Tospearl 105® having a median diameter of 0.41 μm and only 0.4% of the particles having a particle size greater than 0.8 μm (see Table I).

Example No. 3—This was the same as Example No. 1, except the Tospearl 105® was replaced with 0.054 g/m$^2$ ground Tospearl 105® having a median diameter of 0.52 μm and only 2.1% of the particles having a particle size greater than 0.8 μm (see Table I).

Example No. 4—This was the same as Example No. 3, except the Tospearl 105® was employed at 0.215 g/m$^2$.

Example No. 5—This was the same as Example No. 2, except the Tospearl 105® was replaced with 0.108 g/m$^2$ ground Tospearl 105® having a median diameter of 0.52 μm and only 8% of the particles having a particle size greater than 0.8 μm (see Table I).

Example No. 6—This was the same as Example No. 5, except the Tospearl 105® was replaced with 0.108 g/m$^2$ ground Tospearl 105® having a median diameter of 0.50 μm and only 4% of the particles having a particle size greater than 0.8 μm (see Table I).

Dye-Receiving Element

The dye-receiving element consisted of a subbed, microvoided composite film material, as described in U.S. Pat. No. 5,244,861, coated with a dye-receiving layer comprising polyether-modified bisphenol-A polycarbonate Makrolon® KL3-1013 (Bayer AG) (1.71 g/m$^2$), bisphenol-A polycarbonate Lexan 141® (General Electric Co.) (1.40 g/m$^2$), plasticizer Drapex 429® (Witco) (0.26 g/m$^2$), diphenyl phthalate (Eastman Kodak Co.) (0.52 g/m$^2$) and perfluorinated alkylsulfonamidoalkyl ester surfactant Fluorad FC-431® (3M Corp.) (0.012 g/m$^2$) coated from dichloromethane. This receiver layer was overcoated with a polymeric layer consisting of:

a random terpolymer of bisphenol A (50 mole-%) diethylene glycol (43.5 mole-%), and polydimethylsilane blocks (6.5 mole-%) (Eastman Kodak Co.) (0.66 g/m$^2$), 4,4$^1$-isopropylidene-bisphenol-co-2,2$^1$-oxydiethanol polycarbonate (50:50) (Eastman Kodak Co.) (0.108 g/m$^2$), Fluorad FC-431® (0.022 g/m$^2$) and DC-510 (Dow Corning Co.) (0.0027 g/m$^2$) dissolved in dichloromethane.

Size Distribution of Polymethylsilsesquioxane

The particle size distribution of milled and unmilled Tospearl® was determined with a Shimadzu (Kyoto, Japan) Centrifugal Particle Size Analyzer, Model SA-CP3. The data in Table I below show median diameter ($\mu$m) and the fraction of particles greater than 2.4 $\mu$m and 0.8 $\mu$m and 0.7 $\mu$m, respectively, where applicable.

Table I

| Slipping Layer Coating | Measured Median Dia. ($\mu$m) | Particles >2.4 $\mu$m (%) | Particles >0.8 $\mu$m (%) | Particles >0.7 $\mu$m (%) |
|---|---|---|---|---|
| Control 2 | 1.36 | 14.90 | 95 | 100 |
| Comparisons 1 & 2 | 0.54 | 0 | 16 | 25 |
| Example 1 | 0.31 | 0 | 0.0 | 0.1 |
| Example 2 | 0.41 | 0 | 0.4 | 1.7 |
| Example 3 | 0.52 | 0 | 2.1 | 5.1 |
| Example 4 | 0.52 | 0 | 2.1 | 5.1 |
| Example 5 | 0.52 | 0 | 8 | 15 |
| Example 6 | 0.50 | 0 | 4 | 8 |

The above data show that the fractions of large particles for Control 2 and Comparisons 1 and 2 are significantly greater than those for Examples 1 through 6.

Printing Conditions

All images made with the dye-donors were printed under identical conditions. Each of the thermally transferred reflection images was composed of four separate but identical step wedge gradients printed across the width of the receiver. An X-Rite® densitometer (X-Rite Corp.) measuring Status A-Green reflection density was used to determine differences in printing efficiency. The averages of four density readings taken in the Dmax region of the thermally transferred image are shown in Table II.

The imaged prints were prepared by placing the dye-donor element in contact with the polymeric receiving layer side of the receiver element. The assemblage was fastened to the top of a motor driven 53 mm diameter rubber roller and a TDK thermal head L-231, thermostated at 24° C. with a head load of 2 Kg pressed against the rubber roller. The TDK L-231 thermal print head has 512 independently addressable heaters with a resolution of 5.4 dots/mm and an active printing width of 95 mm, of average heater resistance 512 ohms. The imaging electronics were activated and the assemblage was drawn between the print head and roller at 20.6 mm/sec. Coincidentally, the resistive elements in the thermal print head were pulsed on for 127 $\mu$sec every 130 $\mu$sec. Printing maximum density required 32 pulses "on" time per printed line of 4.6 msec. The images were printed with a 1:1 aspect ratio. The maximum printing energy was 5.0 J/cm$^2$.

TABLE II

Status A Density of Printed Images

| Slipping Layer Coating | Particle Coverage (g/m$^2$) | Status A Density |
|---|---|---|
| Control 1 | None | 2.06 |
| Control 2 | 0.054 | 1.54 |
| Comparison 1 | 0.054 | 2.02 |
| Comparison 2 | 0.215 | 2.00 |
| Example 1 | 0.054 | 2.06 |
| Example 2 | 0.108 | 2.10 |
| Example 3 | 0.054 | 2.08 |
| Example 4 | 0.215 | 2.07 |
| Example 5 | 0.108 | 2.10 |
| Example 6 | 0.108 | 2.10 |

The above data show that the introduction of unmiled Tospearl® (Control 2 and Comparisons 1 and 2) into the slipping layer results in an unwanted drop in print density. When the Tospearl® was milled according to the procedure above, the number of large particles was reduced which resulted in a print density equal to or greater than that without Tospearl® (Control 1).

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having on one side thereof a dye layer and on the other side a slipping layer comprising a binder containing polyalkylsilsesquioxane particles wherein less than about 8% of the particles have a diameter of >0.8 $\mu$m.

2. The element of claim 1 wherein less than about 4% of the particles have a diameter of >0.8 $\mu$m.

3. The element of claim 1 wherein said particles have a median diameter of less than about 0.6 $\mu$m.

4. The element of claim 1 wherein said particles are present in said layer in an amount of about 0.05 to 70 weight % of the binder employed.

5. The element of claim 1 wherein said polyalkylsilsesquioxane particles are polymethylsilsesquioxane particles.

6. A process of forming a dye transfer image comprising:

(a) imagewise-heating a dye-donor element comprising a support having on one side thereof a dye layer and on the other side a slipping layer, and (b) transferring a dye image to a dye-receiving element to form said dye transfer image, wherein said slipping layer comprises a binder containing polyalkylsilsesquioxane particles wherein less than about 8% of the particles have a diameter of >0.8 $\mu$m.

7. The process of claim 6 wherein less than about 4% of the particles have a diameter of >0.8 $\mu$m.

8. The process of claim 6 wherein said particles have a median diameter of less than about 0.6 $\mu$m.

9. The process of claim 6 wherein said particles are present in said layer in an amount of about 0.05 to 70 weight % of the binder employed.

10. The process of claim 6 wherein said polyalkylsilsesquioxane particles are polymethylsilsesquioxane particles.

11. A thermal dye transfer assemblage comprising:

(a) a dye-donor element comprising a support having on one side thereof a dye layer and on the other side a slipping layer, and (b) a dye-receiving element comprising a support having thereon a dye image-receiving layer, said dye-receiving element being in a superposed relationship with said dye-donor element so that said dye layer is in contact with said dye image-receiving layer, the improvement wherein said slipping layer comprises a binder containing polyalkylsilsesquioxane particles wherein less than about 8% of the particles have a diameter of >0.8 μm.

12. The assemblage of claim 11 wherein less than about 4% of the particles have a diameter of >0.8 μm.

13. The assemblage of claim 11 wherein said particles have a median diameter of less than about 0.6 μm.

14. The assemblage of claim 11 wherein said particles are present in said layer in an amount of about 0.05 to 70 weight % of the polymeric binder employed.

15. The assemblage of claim 11 wherein said polyalkylsilsesquioxane particles are polymethylsilsesquioxane particles.

* * * * *